US005893171A

United States Patent [19]

Ries

[11] Patent Number: 5,893,171

[45] Date of Patent: Apr. 13, 1999

[54] NURSING COVER-UP

[76] Inventor: Margaret A. Ries, 15140 Sylvester Rd., Reno, Nev. 89511

[21] Appl. No.: 08/865,825

[22] Filed: May 30, 1997

[51] Int. Cl.[6] ..... A41D 1/00

[52] U.S. Cl. ..... 2/48; 2/52; 2/104

[58] Field of Search ..... 2/48, 52, 104, 2/49.1, 50, 51

[56] References Cited

U.S. PATENT DOCUMENTS

| | | | |
|---|---|---|---|
| 890,614 | 6/1908 | Culver | 2/104 |
| 1,098,155 | 5/1914 | Knapp | 2/104 |
| 1,290,142 | 1/1919 | Elowsky | 2/104 |
| 2,417,888 | 3/1947 | Schuster | 2/104 |
| 4,004,294 | 1/1977 | Pinch | 2/104 |
| 4,031,566 | 6/1977 | Johnson | 2/104 |
| 4,144,593 | 3/1979 | Timmons | 2/104 |
| 4,208,743 | 6/1980 | Whitcraft | 2/104 |
| 4,280,228 | 7/1981 | Sulzmann | 2/104 |
| 4,566,136 | 1/1986 | Echols | 2/104 |
| 4,601,068 | 7/1986 | Frechette | 2/104 |
| 4,651,349 | 3/1987 | Heiler | 2/104 |
| 4,660,227 | 4/1987 | Abramson | 2/104 |
| 4,663,782 | 5/1987 | Knox et al. | 2/104 |
| 4,995,116 | 2/1991 | Beauchamp et al. | 2/104 |
| 5,469,582 | 11/1995 | Livingston | 2/48 X |
| 5,479,662 | 1/1996 | Runco | 2/48 X |
| 5,544,364 | 8/1996 | Weber | 2/48 X |
| 5,652,958 | 8/1997 | Farrell-Mestas | 2/48 |

*Primary Examiner*—C. D. Crowder
*Assistant Examiner*—Shirra L. Jenkins

[57] ABSTRACT

This device, a nursing cover-up (10), allows a nursing mother to breast feed her child in public without fear of exposing herself to others, but allows herself to view the child during the feeding (19). The nursing cover-up is a piece of fabric attached to the front of the mother's clothing by clips, clamps, or fasteners (12A & 12B) or by optional neck strap (17). The nursing cover-up has a flexible shapeable coated wire (15) sewn into the upper edge of the nursing cover-up (10) that provides support to the nursing cover-up allowing the mother to shape or mold the edge of the nursing cover-up outward (19); thus permitting her to see the child throughout feeding while prohibiting others from seeing in. The shield and slit opening (16 & 18) provides access for the mother's hand to the underside of the nursing cover-up permitting her to move or manipulate her nipple as needed. A pocket is provided for storage (20). This device can be produced in a one size fits all which is easy to take on and off. It can be folded small enough to fit into a diaper bag or purse. The fabric is light and the sides are open which allows ample ventilation for the child.

5 Claims, 2 Drawing Sheets

NURSING COVER-UP

BACKGROUND

1. Field of Invention

This invention relates to a cover which provides privacy for use by a nursing mother while breast feeding a baby in a public place.

2. Description of Related Art

There exists many forms of blankets and coverings for a woman's upper torso for use in screening a mother's breast from view when in public. While traditional blankets and diapers have been used for this purpose, a blanket or diaper draped over her shoulder will not enable the mother to view the breast feeding baby and there is no way of securing the blanket or bib to the mother, thus risking the possibility of slipping off and exposing the mother's breasts.

As a result, numerous types of securable privacy coverings have been developed. These privacy coverings have either been securable at the mother's shoulder (U.S. Pat. Nos. 4,964,172; 4,989,268; and 5,038,411) or around her neck in the manner of a bib (for example, U.S. Pat. Nos. 4,631,754; 4,716,597; 4,924,528; 4,987,612; 5,034,999; 5,259,068; and 5,479,662). The first type provide only a limited coverage area, posing problems if the child is nursed from both sides due to the need to remove and reposition the shield on the opposite shoulder when switching sides, and their holding mechanisms (e.g. a hook-like component) could be uncomfortable if too small or fall off or slip if too big.

The bib type privacy shields have possessed other deficiencies. For example, if secured around the neck of the mother, a bib type covering has a tendency to drape itself over the child and if large enough to provide adequate coverage of the mother's torso, provides little ventilation to the baby and obstructs the ability of the mother to view the baby. To alleviate this situation, various techniques have been utilized. In the case of U.S. Pat No. 5,479,662, the privacy covering for nursing mothers disclosed therein is fastened to the mother by use of a hook and loop self-adhering detachable closure and a curved flexible flat strip is hemmed into a central portion of the upper edge of a blanket which allows viewing of the child. However, in practice the privacy covering falls against the mother's chest and does not stand out on its own. The strip is too heavy and has inadequate structural strength to allow visibility for the mother without the use of her hand(s) to move the strip and look in.

Also in the case of U.S. Pat. No. 4,631,754, the nursing scarf disclosed herein is tied so as to produce a neck opening substantially larger than the wearer's neck opening and the upper margin of the scarf is pleated, to provide an opening through which the mother may view her nursing baby. Nevertheless, in practice, the pleats have little structural strength and with a opening that is large enough to insure the ability to view the child, it would be difficult to arrange the scarf so as to achieve both sufficient screening of the nursing child relative to onlookers and visibility for the mother.

In U.S. Pat. No. 4,716,597, a nursing garment is disclosed which is in the form of a poncho that is worn by placing it over the head of the mother. In an attempt to enable the mother to be able to view her baby, a rigid hoop is hemmed into the neck opening. However, because the rigid hoop must be large enough to allow the mother's head to pass through it and there is no means to hold it in a horizontal position, it has a tendency to hang against the mother's chest, effectively blocking the visibility of the child. Moreover, such a poncho type garment is large and cumbersome to carry around and creates the problem that the mother's hair has the possibility to become messed-up as a result of putting it on and off, thereby making it use undesirable.

OBJECTS AND ADVANTAGES

Accordingly, several objects and advantages of my invention are the use of clips 12A & 12B to hold the nursing cover-up 10 to the front of the mother's clothing so that is will not fall off during the feeding process. Also a flexible shapeable coated, fourteen-gauge wire 15 sewn into the upper edge of a nursing cover-up provides support and flexibility to the nursing cover-up, thus allowing the mother to shape the edge of the nursing cover-up so that the mother can see the baby while feeding 19. The wire is strong enough to support the nursing cover-up in a horizontal position close enough to the mother's body to prohibit others from seeing the mother's bare breasts. A covered slit opening allows the mother access to the inside in order to manipulate her nipple or access to the baby if needed. A pocket 20 is provided on the front of the shield 16 used to cover the slit opening 18; the pocket furnishes a convenient storage area for such items as pacifiers or tissues. Additionally, at the mother's option, a strap 17 is supplied so the mother can attach the nursing cover-up around her neck if she is not wearing clothing conducive to the use of the clips.

DRAWING FIGURES

In the drawings, closely related figures have the same number but different alphabetic suffixes.

REFERENCE NUMERALS IN DRAWINGS

Figure 1:
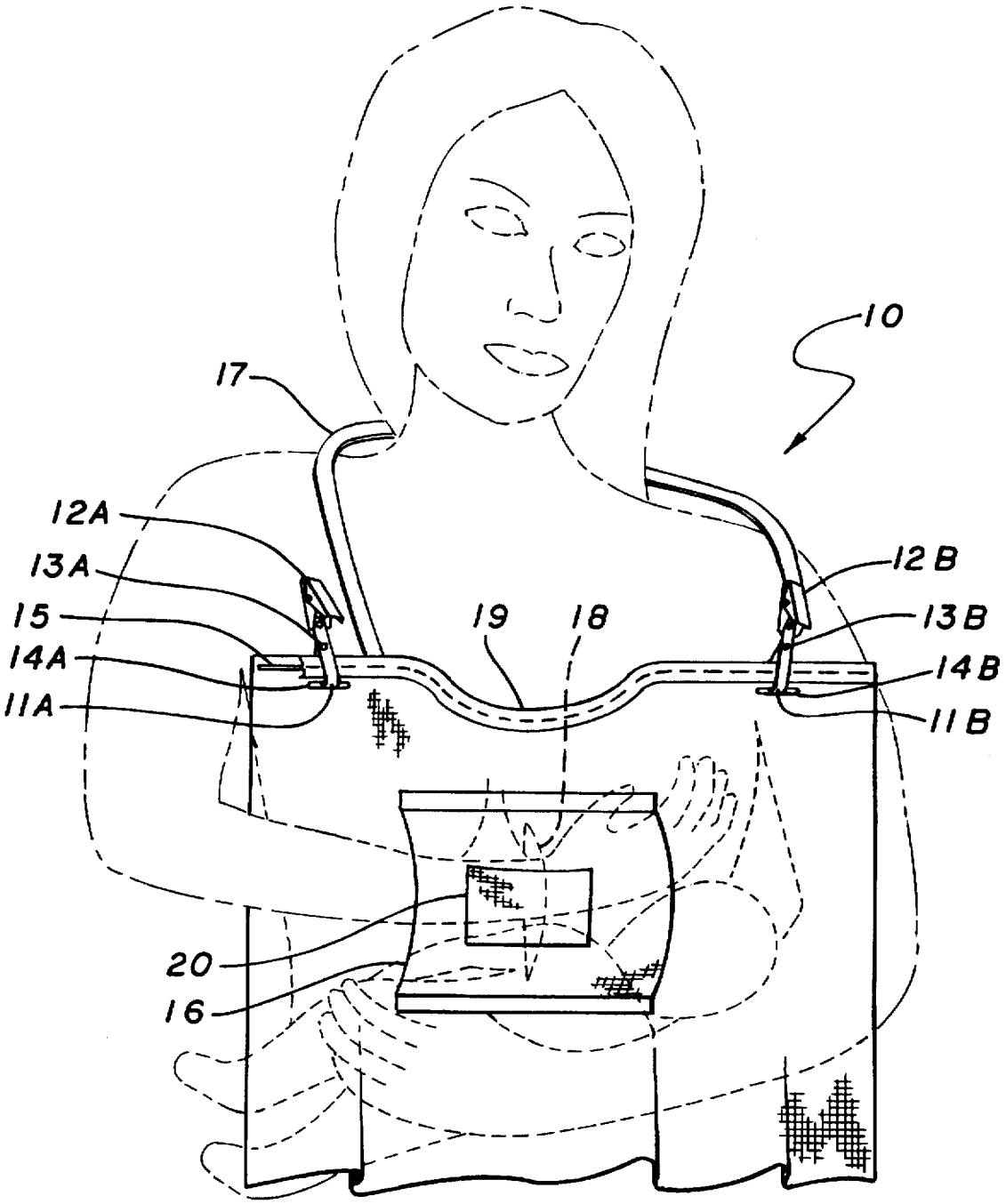
FIG. 1 shows the nursing cover-up as worn by a nursing mother

10 nursing cover-up
11A/B plastic strips
12A/B clips
13A/B snaps
14A/B button holes
15 flexible shapeable coated wire
16 shield
17 optional strap
18 slit opening
19 opening for mother to view child
20 pocket

SUMMARY OF THE INVENTION

The nursing cover-up provides privacy for mothers who breast feed in public. This device allows the mother to view the child while feeding, but prevent others from seeing inside. The device uses clips or the optional strap to attach the nursing cover-up to the front of the mother's clothing. The apparatus also utilizes a flexible shapeable coated wire sewn into the upper edge of the nursing cover-up which provides support to the nursing cover-up thus permitting it to stand out on its own; therefore, creating an opening between the mother and the nursing cover-up enabling the mother to view the baby while feeding. A slit opening, centered in the upper portion of the nursing cover-up, permits access to the baby and the underside of the nursing cover-up for the mother's hand from the outside. The shield (similar to a pocket, but open on two sides) is attached to the nursing cover-up over the slit opening.

DESCRIPTION—MAIN EMBODIMENT

Figure 2:
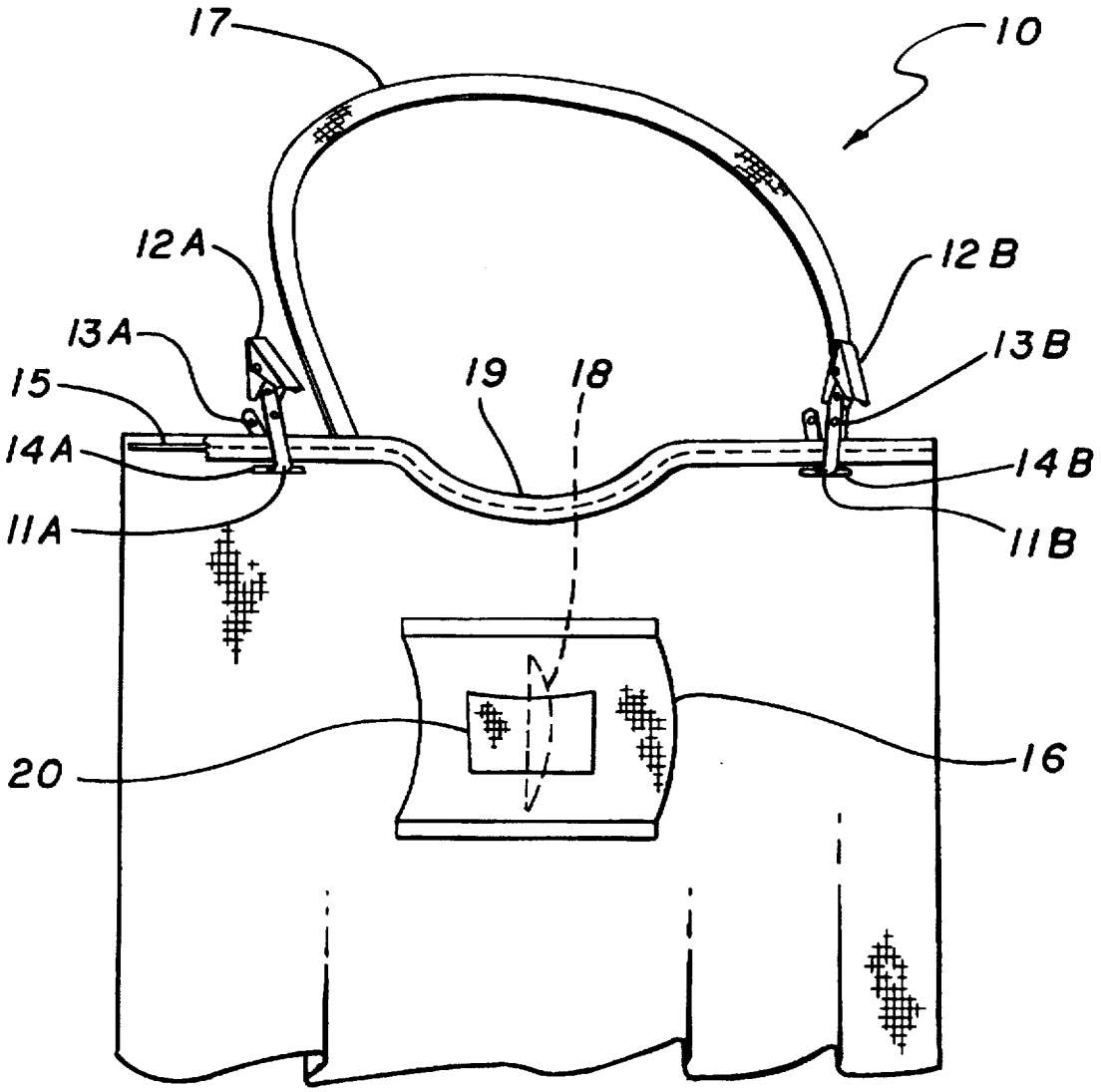
FIG. 2 shows the frontal view of the nursing cover-up.
Figure 3:
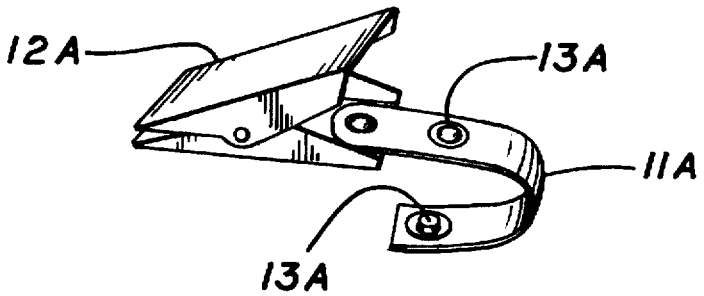
FIG. 3 shows the detachable clip

A typical embodiment of the nursing cover-up is illustrated in FIG. 1 as worn on a nursing mother. The nursing-cover up 10 is comprised of a light-weight breathable fabric with two clips 12A & 12B that may be removed for washing. As illustrated in FIGS. 1 & 2, each clip 12A & 12B is attached to the top edge of the nursing cover-up 10 by a plastic strip 11A & 11B that feeds through a button hole 14A & 14B and is secured as a loop with a snap 13A & 13B. The clips 12A & 12B attach to the front of the mothers clothing to hold the nursing cover-up 10 in place, or the mother may utilize the optional strap comprised of a strip of fabric 17. One end of the optional strap 17 is sewn next to one clip (i.e. 12A) and can be looped around the mother's neck and secured to the other clip (i.e. 12B) to keep the nursing cover-up 10 attached. A flexible wire 15 is sewn into the upper edge of the nursing cover-up 10. The flexible wire 15 may be made of metal or any other suitable deformable material. An especially suitable material is a fourteen-gauge plastic or rubber insulated wire with a pliability of 0 to 180 degrees. Other materials may also be suitable. A rectangular shield 16 is attached to the nursing cover-up 10 by sewing the two together along the top and bottom edge of the shield 16 to the upper middle portion of the nursing cover-up. The sides of the shield 16 are not sewn to the nursing cover-up 10. As illustrated in FIG. 1, the shield 16 forms a two-sided pocket, and allows access to the slit opening 18 which is centered under the shield 16. The slit opening 18 is edged/surged on both sides. A pocket 20 is attached to the cover piece of fabric 16 by sewing the bottom edge and both sides of the pocket 20 to the shield 16.

OPERATION—MAIN EMBODIMENT

First the mother puts on the nursing cover-up 10 by attaching the clips 12A & 12B to the front of her clothing, or utilizing the optional strap, covering the child and her breasts from the view of others. One end of the optional strap is sewn near one of the clips (i.e. 12A) and the optional strap is placed around the mother's neck and secured by the other clip (i.e. 12B) if the optional strap is utilized. Then the mother shapes the flexible coated wire 15 outward, thus providing an opening between the mother and the nursing cover-up for the mother to view the child while feeding 19. The ends of the flexible shapeable coated wire 15 can also be formed around the mother's shoulders or armpits for added privacy.

The mother then places her hand under the shield 16 and through the slit opening 18 in order to place her nipple into the child's mouth for feeding. A pocket 20 is provided which may be used for storage (i.e. pacifier, tissue, chapstick).

DESCRIPTION AND OPERATION OF ALTERNATIVE EMBODIMENTS

The nursing cover-up may also be used as a shading or wind protection device. It can be draped over or near the desired object to be protected or can be attached to items using the clips or strap. The nursing cover-up can also act as a practical blanket to keep warm. If needed, the apparatus may be utilized as a changing pad for changing the baby's clothing or diaper.

CONCLUSION, RAMIFICATIONS, AND SCOPE

Thus the reader will see that the nursing cover-up provides a highly reliable, lightweight, simple, easy-to-use, yet economical device that can be used by breast feeding mothers in public. Furthermore, the nursing cover-up has the additional advantages in that:

- no special clothing is required to use this apparatus in public
- it is compatible and easily transportable in a purse or bag
- it can be machine washed without the need for dry cleaning
- it permits the production of the cover-up without requiring the manufacturer to use a complex pattern (i.e. articles of clothing)
- it can be easily manufactured in many different colors and textures/types of fabric Although the description above contains many specificities, these should not be construed as limitations on the scope of the invention, but as merely providing illustrations of some of the presently preferred embodiments thereof. Many variations are possible. For example, the nursing cover-up can be produced using different materials, different shapes, the device can be used as a shading device, a receiving blanket or a changing pad.

Accordingly, the scope of the invention should be determined by the appended claims and their legal equivalents, rather than by the examples given.

I claim:

1. A privacy cover for use by a mother while breast feeding a baby comprising;

A) a cover of sufficient size to conceal from viewing the arms and chest of the mother and a baby while held in the arms of the mother during breast feeding, said cover having an upper edge, said upper edge defining an edge no shorter than the longest edge of the cover, the length of the upper edge at least long enough to wrap around the portion of the chest and shoulder of the mother above the breast;

B) removable clips attached to the cover proximate the upper edge for attaching the cover to the mother's clothing to prevent said cover from falling off the mother and for attaching at least one end of a neck encircling support piece; and C) a flexible shapable coated wire attached proximate the entire length defined by the, upper edge, structurally supporting said upper edge in selected position, and, upon the cover attachment to the mother, using the attachment means, said flexible shapable coated wire providing the mother a shapeable upper edge to facilitate viewing of the baby during breast feeding; and concealing the baby and the mother's breast from the view of others during breast feeding.

2. The privacy cover of claim 1 wherein said attachment means comprises a strap attached to said cover for looping around the mother's neck.

3. The privacy cover of claim 1 wherein said cover comprises an opening for allowing the mother to reach inside of said cover to manipulate the baby and the mother's breast.

4. The privacy cover of claim 3 further comprises a shield attached to said cover for covering said opening in said cover.

5. The privacy cover of claim 4 further comprising a pocket attached to said shield for holding objects for the mother and/or baby.

* * * * *